United States Patent [19]

Sobolewski et al.

[11] Patent Number: 4,520,861

[45] Date of Patent: Jun. 4, 1985

[54] METHOD AND APPARATUS FOR ALLOYING CONTINUOUSLY CAST STEEL PRODUCTS

[75] Inventors: Robert Sobolewski, Streetsboro; David N. Eberle, North Canton, both of Ohio

[73] Assignee: Republic Steel Corporation, Cleveland, Ohio

[21] Appl. No.: 553,163

[22] Filed: Nov. 18, 1983

[51] Int. Cl.[3] ..... B22D 11/10

[52] U.S. Cl. ..... 164/473; 164/475; 164/488; 164/415; 164/437; 222/594; 222/597; 222/602

[58] Field of Search ..... 164/473, 133, 135, 337, 164/437–440, 488–490, 415; 222/594, 597, 601, 602

[56] References Cited

U.S. PATENT DOCUMENTS

| | | | |
|---|---|---|---|
| 2,997,386 | 8/1961 | Feichtinger | 75/93 R |
| 3,357,692 | 12/1967 | Bakkerus | 266/216 |
| 3,435,875 | 4/1969 | Howard et al. | 164/133 |
| 3,459,346 | 8/1969 | Tinnes | 266/207 |
| 3,514,285 | 5/1970 | Bakkerus | 75/129 |
| 3,814,405 | 6/1974 | Ormaeches | 266/216 |
| 3,886,992 | 6/1975 | Maas et al. | 164/473 |
| 3,888,294 | 6/1975 | Fastner et al. | 164/475 |
| 3,911,993 | 10/1975 | Caudill et al. | 164/473 |
| 3,931,913 | 1/1976 | Meier | 222/592 |
| 3,935,895 | 2/1976 | Fastener et al. | 164/475 |
| 3,954,134 | 5/1976 | Maas et al. | 164/266 |
| 4,006,772 | 2/1977 | Koenig | 164/475 |

FOREIGN PATENT DOCUMENTS

| | | | |
|---|---|---|---|
| 1154054 | 6/1969 | United Kingdom | 164/337 |
| 2096032A | 10/1982 | United Kingdom | 164/473 |

*Primary Examiner*—Nicholas P. Godici
*Assistant Examiner*—Kenneth F. Berg
*Attorney, Agent, or Firm*—Watts, Hoffmann, Fisher & Heinke

[57] ABSTRACT

Apparatus and method for alloying continuously cast steel products wherein a wire of alloying material, e.g. lead, is fed through the center of the stopper rod to its nose where the wire melts and dissolves into the stream of liquid steel flowing out of the tundish. The guide passage for the wire and a cooperating hole in the nose of the stopper rod are temporarily closed by heat meltable means which prevents steel from entering and clogging the hole in the passage before a steady-state flow condition is achieved.

6 Claims, 4 Drawing Figures

METHOD AND APPARATUS FOR ALLOYING CONTINUOUSLY CAST STEEL PRODUCTS

DESCRIPTION

1. Technical Field

The present invention relates generally to the continuous casting of steel, and more specifically to method and apparatus for introducing alloying material, especially lead, in wire form during the process of continuously casting steel.

2. Background Art

A major obstacle to leading steel is its low solubility and slow dissolution rate in liquid steel. Considerable agitation and/or residence time is necessary to reach the solubility limit at a given temperature. In most instances, neither the residence time nor the agitation required to dissolve enough lead to reach required specifications is available. As a result, an appreciable and excessive amount of lead must be added.

A known practice of adding lead to liquid steel during conventional ingot casting comprises propelling lead shot into the teeming stream from the ladle. Another known prior art proposal involves feeding shot from a hopper into the bore of a hollow stopper rod of a bottom pour ladle. When the stopper rod is raised, the lead shot flows from its end into the center of the liquid metal stream exiting the ladle. Still another known practice requires stirring molten steel in a ladle by bubbling argon up through the melt from the bottom, while feeding lead wire or shot down into the melt at the exit area of the argon bubbles.

The conventional practices of adding lead to molten steel during ingot casting have a number of drawbacks. As mentioned previously, an excess amount of lead to reach the final aim content of 0.15–0.35% must be added to the steel due to the poor recovery which is typically in the range of from 50 to 70%. The excess lead tends to settle out in lead globules and accumulate at the bottom of the ingot or ladle. This can necessitate cropping a large portion of the ingot from the bottom which results in poor yield of ingot leaded products. Ladles employed in ladle leading processes can be used only for that purpose. Another disadvantage is that excessive fuming of lead added in an open atmosphere presents a hazardous environment to personnel.

The typical high lead contents of 0.15–0.35% also promote sweating and fuming during machining operations. This condition can be hazardous and may require protective measures to be taken during machining.

DISCLOSURE OF THE INVENTION

The present invention provides a practical and efficient apparatus and method for adding alloying wire to liquid steel during a continuous or strand casting process. The apparatus generally comprises a stopper rod for controlling the flow of metal from a tundish nozzle, a guide passage in the stopper rod through which a wire can be fed, a cooling passage adjacent the guide passage, a hole in one end of the rod forming an enlarged extension of the guide passage, heat meltable plug means temporarily closing the hole in the end of the stopper rod, and heat meltable closure means for temporarily closing the guide passage.

In a preferred form of the apparatus, the end of the guide passage in the stopper rod is closed by aluminum foil or the like, and the hole in the end of the stopper rod is closed by a copper cap. These two elements have been found essential to the successful practice of the invention. When the operator raises the stopper rod at the start of a casting operation, either to clear the nozzle of skull metal or to initiate pouring, the steel flow rate and casting speed are not stablized. As a result, the ferrostatic head in the tundish can cause liquid steel to be pushed up into the end of the stopper rod to block either the wire passageway or the stopper rod hole. The copper cap and the aluminum foil prevent this from happening and serve to keep the passageway and hole clear until a steady-state flow condition has been established and the effect of the ferrostatic head has been overcome. In actual operation, the copper cap may melt just after the stopper rod is initially opened, while the aluminum foil serves as a back-up measure to prevent liquid metal from entering the guide passage until the steady-state pouring condition is achieved.

The method which forms another aspect of the invention is an improvement in a process of continuously casting steel products wherein a supply of liquid steel in a tundish flows out through a nozzle and a cooperating shroud into a casting mold while an alloying wire and an inert gas are fed through a gas cooled passage in a stopper rod to the area of the nozzle, the flow of liquid steel from the nozzle opening being controlled by raising and lowering the stopper rod in relation to the nozzle. The improvement comprises the steps of temporarily closing the guide passage and a cooperating hole in the nose of the stopper rod with heat meltable closure means, seating the nose of the stopper rod to close the nozzle while liquid steel is introduced into the tundish, initiating pouring by raising the stopper rod from the nozzle, and thereafter melting out the closure means to permit the alloying material and inert gas to escape from the stopper rod when a steady-state flow condition of liquid steel past the stopper rod nose has been attained.

The apparatus and method of the present invention are especially useful for the purpose of leading steel. The turbulence in the submerged shroud breaks up the liquid lead into small droplets which can readily and thoroughly dissolve. This makes it possible to achieve the lead solubility limit at any particular temperature without the addition of excessive amounts of lead. There is almost complete recovery of the lead and an even distribution in the solidified billet. Since the lead is evenly distributed with no large inclusions over about 10 microns, a low percentage of lead is sufficient to meet machinability requirements and specifications.

The practice of the invention is carried out in a closed system so that lead is not exposed to the atmosphere and a hazardous environment is avoided. The low lead levels that are made possible by the practice of the invention contribute to a significant decrease of fuming during casting and machining operations. Any lead fumes that are evolved can be controlled easily and inexpensively.

While the new method and apparatus are specifically described in connection with the addition of lead, it will be apparent and is to be understood that they can be used for other alloying additions. It is contemplated, for example, that the invention can be practiced to advantage with aluminum wire and with materials such as calcium and sulfer clad in steel or aluminum sheath.

Other features, advantages and a fuller understanding of the invention will be had from the following detailed description and the accompanying drawings.

BEST MODE FOR CARRYING OUT THE INVENTION

Figure 1:
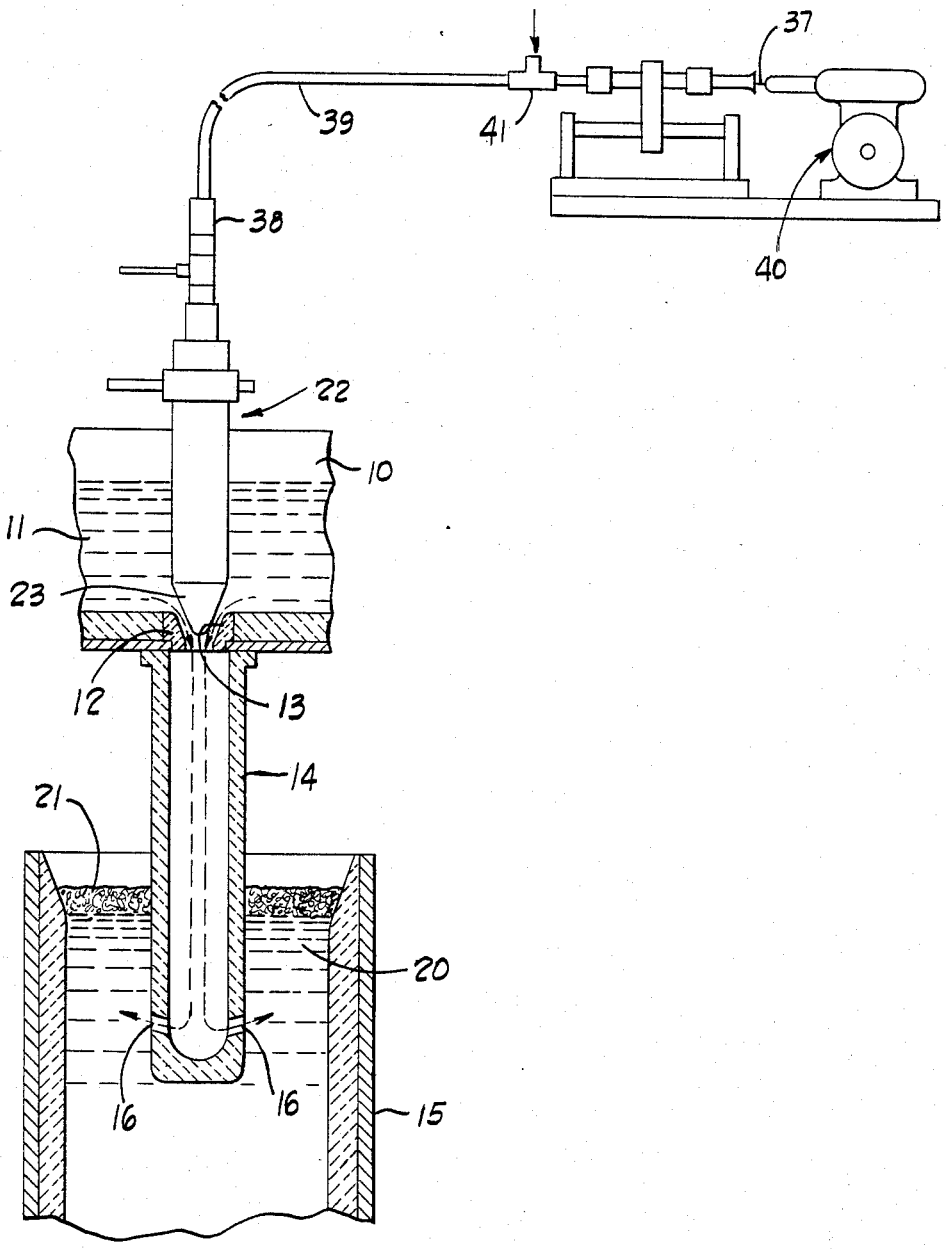
FIG. 1 is a schematic, fragmentary view, partially in cross-section, of a continuous casting system embodying the apparatus of the present invention.

Referring now to the drawings, and to FIG. 1 in particular, the illustrated continuous casting system includes a tundish 10 which holds a supply of liquid steel 11. A nozzle 12 is fitted into the bottom of the tundish 10 and defines a pouring opening 13. A tubular pouring shroud 14 extends down from the tundish opening 13 into the upper portion of a continuous casting mold 15. The lower end of the pouring shroud 14 is provided with discharge ports 16.

When the illustrated apparatus is used for pouring, the ported lower end of the shroud 14 is submerged in the molten metal 20 in the continuous casting mold 15. In accordance with conventional practice, the surface of the liquid steel 20 is protected by a liquid slag cover 21. The flow of molten metal down through the shroud 14 is discharged through the ports 16 beneath the surface of the steel 20 and the slag cover 21.

The flow of liquid steel from the tundish 10 is controlled by a hollow stopper rod assembly 22 which can be raised and lowered by an attached operating mechanism (not shown). The lower end of the stopper rod assembly 22 has a nose 23 which seats in the nozzle 12 to close the opening 13 when the stopper rod assembly is in its lowered position.

Figure 2:
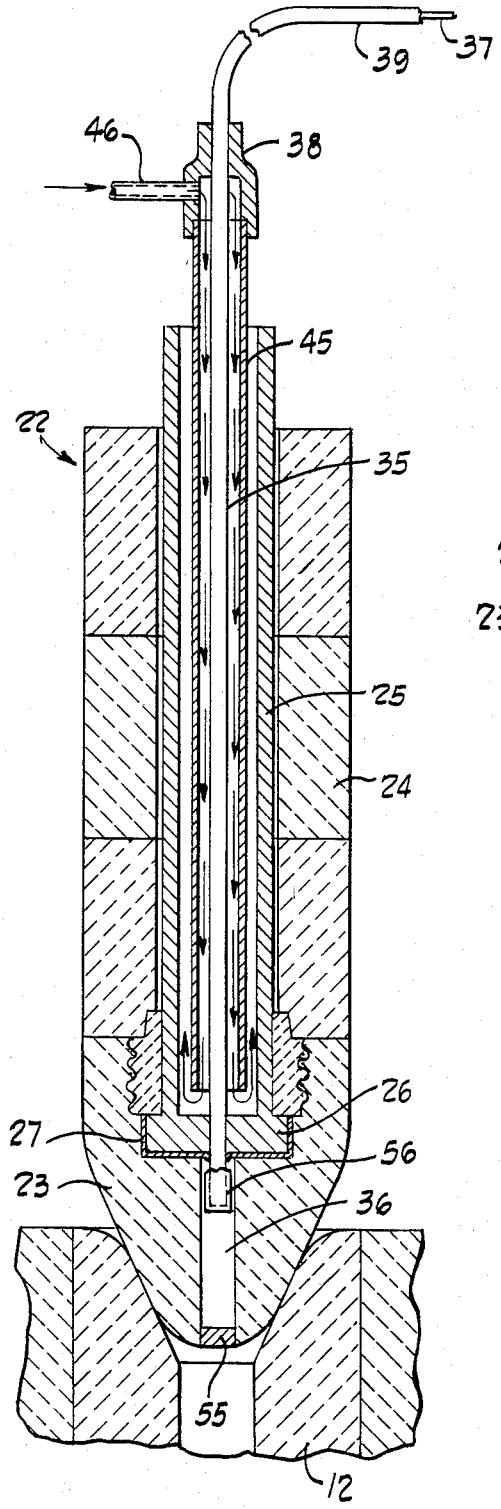
FIG. 2 is an enlarged, fragmentary cross-sectional view of a portion of the apparatus shown in FIG. 1.

Referring to the detailed construction of FIG. 2, the stopper rod assembly 22 is shown to comprise a hollow refractory body 24 which is joined to the nose or end portion 23. A metal sleeve 25 having a lower end flange 26 extends into the body 24. The flange 26 is cemented in the nose portion 23 by a suitable cement 27. One cement which has been found satisfactory for bonding metal to graphite refractory is comprised of a high alumina base with a sodium and/or potassium silicate binder.

The hollow stopper rod assembly 22 is also provided with an axially extending guide tube 35 which forms a passage through which a wire can be fed into the nose 23. As shown in FIG. 2, the lower end of the tube 35 extends through the flange 26 of the sleeve 25 into a hole 36 in the nose 23. It will be seen that the hole 36 is larger than the diameter of the tube 35. If steel washes up and solidifies on the inner wall of the nose 23 during casting, the large diameter of the hole 36 allows enough room for passage of the wire 37. The upper end of the tube 35 extends from the sleeve 25 and is connected by an adapter 38 to a stainless steel guide tube 39. The wire 37 is fed into the remote end of the tube 39 by a wire feeder 40. Provision is also made at 41 for introducing argon or other inert gas into the tube 39 along with the wire 37. The purpose of the argon gas is to protect against reoxidation. It has been found desirable to keep the argon flow rate low, i.e., about 4.0 standard cubic feet per hour, in order to prevent turbulence on the surface of the metal in the mold which can cause surface imperfections in the cast billet.

The wire guide tube 35 in the stopper rod assembly 22 is surrounded by a cooling pipe 45. The lower end of the pipe 45 is spaced above the flange 26 of the sleeve 25. Cooling air is introduced into the pipe 45 at 46. The cooling air introduced into the pipe 45 flows out of its lower end into the interior of the sleeve 25 and is then exhausted from the top of the sleeve. The cooling air introduced into the pipe 45 and the inside of the sleeve 25 serves to cool the stopper rod assembly 22 and also prevent premature melting of the wire 37.

In accordance with the present invention, the lower end of the hole 36 in the stopper rod nose 23 is closed by a heat meltable element 55, such as a copper cap or the like. The lower end of the wire guide tube 35 which is spaced above the cap 55 is initially covered by aluminum foil 56 or other heat meltable material. The elements 55, 56 are essential elements of the present invention and serve to prevent the hole 36 and the guide tube 35 from being blocked by frozen metal. At the start of the pouring operation before a steady-state flow condition is attained, the ferrostatic pressure of the metal in the tundish 10 can cause liquid steel to be pushed into the hole 36 and into the guide tube 35. The condition can also occur at any time the operator lifts the stopper rod too high so that the velocity of steel flowing past the nose of the stopper rod is effectively lowered. When a steady-state flow condition through the nozzle 12 has been achieved, the velocity of the metal flowing past the nose 23 of the stopper rod is normally sufficient that the metal will not enter the hole 36.

Figure 3:
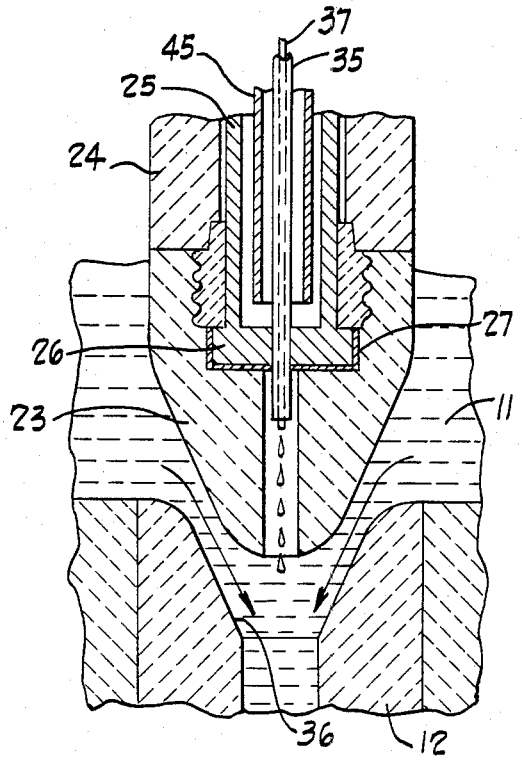
FIG. 3 is an enlarged, fragmentary view in cross-section of the nose of the stopper rod when it is unseated from the nozzle.

During operation of the entire system, the nose 23 of the stopper rod 22 is initially seated in the nozzle 12 as shown in FIG. 2. In this position the hole 36 is temporarily closed by the copper cap 55 and the end of the tube 35 is temporarily closed by the aluminum foil 56. When the operator raises the stopper rod 22 toward the position shown in FIG. 3, the copper cap 55 initially protects against liquid steel entering the hole 36 in the manner described, but quickly melts. The entire guide tube 35, 39 may be preloaded with argon gas to about 10 psi before start-up to blow out any steel wash-up after the copper cap 55 melts. The foil 56 provides a protective measure to prevent metal from entering the end of the tube 35 until the steady-state flow condition has been achieved.

When the condition of steady-state flow has been established, the liquid steel flows out of the tundish in an annular stream past the nose of the stopper rod assembly and through the shroud 14. At the same time, the wire 37 is fed through the stopper rod assembly. The wire feed rate is controlled so that a constant, desired amount of alloying material is added according to the rate at which liquid steel is flowing through the nozzle 12. When the wire reaches the end of the tube 35 in the hole 36, the wire melts and flows into the liquid steel. The turbulence in the submerged shroud 14 breaks the liquid alloying material, e.g. lead, into small droplets which readily dissolve up to the solubility limit at the particular pouring temperature of the steel. The alloyed, liquid steel then discharges from the ports 16 below the surface of the metal 20 in the mold 15.

It has been discovered that the concept of feeding alloying material in the form of the wire through a hollow stopper rod so that the wire can melt and dissolve into the stream of liquid steel flowing past the nose of the rod offers unexpectedly improved and important advantages in the case of leading continuously cast steel. This technique makes it possible to achieve the solubility limit of lead at a particular temperature without the typical long residence time and/or agitation of the melt. The billet cast in accordance with the invention is characterized by a uniform distribution of the lead particles throughout the metal and by the absence of large globules or lead inclusions larger than about 10 microns. This improves the billet yield and makes it possible to reduce the lead content, while still producing a product having the desired machinability.

The ability to produce a continuously cast steel product characterized by a low lead content and good machinability is demonstrated by single point turning tests performed on continuously cast steel heats leaded in accordance with the invention and comparison heats consisting of conventionally leaded ingot heats. The nominal compositions of the various heats involved in the tests are given in Table I. It will be seen that the average lead content of the continuously cast heats produced in accordance with the invention is appreciably less than that of the conventionally leaded ingot cast heats.

TABLE I

| Heat Number | C | Mn | Si | Cu | Ni | Cr | Mo | S | Al | Pb |
|---|---|---|---|---|---|---|---|---|---|---|
| CHEMISTRY OF HEATS | | | | | | | | | | |
| Ingot Leaded Comparison Heats | | | | | | | | | | |
| A | .22 | .83 | .45 | .21 | .43 | .55 | .15 | .020 | .038 | .24 |
| B | .20 | .75 | .25 | .13 | .41 | .58 | .16 | .021 | .028 | .15/.23 |
| C | .19 | .77 | .25 | .19 | .44 | .49 | .16 | .020 | .030 | .12/.15 |
| D | .21 | .83 | .25 | .20 | .45 | .50 | .16 | .019 | .027 | .11/.22 |
| Semi-Leaded Strand Cast Heats | | | | | | | | | | |
| E | .20 | .74 | .19 | .14 | .42 | .51 | .16 | .025 | .038 | .07/.09 |
| F | .20 | .82 | .24 | .15 | .41 | .55 | .19 | .029 | .032 | .09/.10 |
| G | .22 | .76 | .20 | .16 | .38 | .47 | .15 | .026 | .034 | .15/.16 |
| H | .20 | .79 | .24 | .12 | .44 | .46 | .16 | .026 | .044 | .06/.10 |
| I | .22 | .81 | .34 | .16 | .42 | .53 | .15 | .028 | .040 | .10/.13 |

Figure 4:
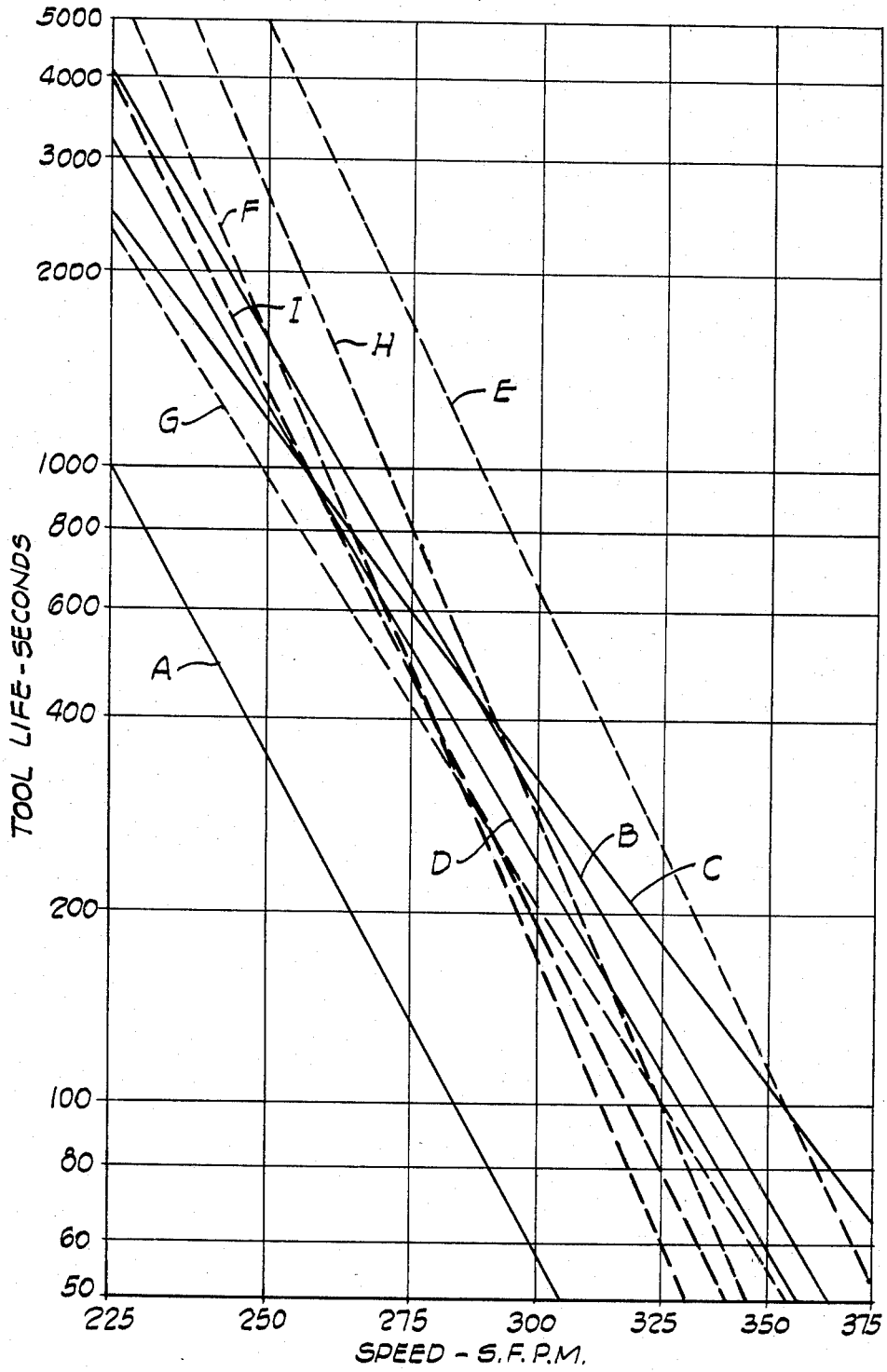
FIG. 4 is a graph showing the results of single point turning tests performed on various leaded steels, including those produced in accordance with the present invention.

FIG. 4 presents the relationship between cutting speed and tool life for the single point turning tests performed on the steel heats of Table I. The tests were run without coolant on a heavy-duty lathe using high-speed steel tools. A standard depth of cut of 0.050 inches and feed of 0.0105 inches per revolution was utilized for all tests, while the speed was varied between 225 and 375 surface feet per minute. The results of the tests were computer analyzed using a simple linear regression technique which defines the best fit line for a group of data. It will be seen from FIG. 4 that four of the continuously cast heats (F, G, H, I) and three of the ingot cast heats (B, C, D) are quite similar in their machining response. The continuously cast heat E machined significantly better than the rest of the heats, while the ingot cast heat A indicated a substantially poorer machinability response.

Information was also obtained as to the cutting speeds which may be attained while maintaining constant tool lives of 5, 10, 20 and 30 minutes ($V_5$, $V_{10}$, $V_{20}$, and $V_{30}$, respectively) under the standard test conditions. This information is recorded in Table II for the individual steel heats and also for each group of heats when the total data for each group are combined. An increase in cutting speed at a given tool life may be translated to an increase in productivity. As presented in Table II, an average overall increase in productivity of approximately 8% over conventionally leaded ingot cast materials was gained when machining the leaded continuously cast products.

Table II also lists the correlation coefficients which were obtained for each heat's data set. The correlation coefficient is an indication of the variability of the tool life-cutting speed relationship within the group of data. Variations in machinability will occur within a product due to the inherent inhomogeneity of the bars with respect to chemistry, non-metallic inclusion morphology, and hardness. A correlation coeffecient which approximates 1 indicates a more uniform machining response throughout the test bar. Table II shows that the uniformity of the continuously cast heats was excellent, with the correlation coefficients ranging from 0.903 to 0.979. The uniformity of machining response was lower in the case of the conventionally leaded ingot cast products, with the correlation coefficients ranging from 0.800 to 0.893.

TABLE II

| Heat Number | $V_5$ MIN. | $V_{10}$ MIN. | $V_{20}$ MIN. | $V_{30}$ MIN. | Correlation Coefficient |
|---|---|---|---|---|---|
| Semi-Leaded Strand Cast Heats | | | | | |
| E | 320.5 | 301.1 | 282.9 | 272.7 | .903 |
| F | 285.0 | 269.7 | 255.3 | 247.2 | .950 |
| G | 286.7 | 264.4 | 243.8 | 232.5 | .979 |
| H | 297.3 | 281.3 | 266.1 | 257.6 | .951 |
| I | 286.2 | 268.9 | 252.7 | 243.7 | .955 |
| All strand Cast | 296.0 | 273.2 | 252.1 | 240.6 | .834 |
| Fully Leaded Ingot Cast Heats | | | | | |
| A | 253.7 | 237.4 | 222.1 | 213.6 | .800 |
| B | 299.4 | 277.8 | 257.7 | 246.7 | .819 |
| C | 302.8 | 274.8 | 249.4 | 235.6 | .830 |
| D | 292.0 | 270.9 | 251.2 | 240.4 | .893 |
| All Ingot Cast | 288.9 | 257.1 | 228.9 | 213.9 | .655 |

It will be seen from the machinability tests reported above that it is possible to produce semi-leaded continuously cast steel products displaying machinability response which is at least equal to that of fully leaded ingot cast products. At the same time, it is possible to achieve more uniform machinability of semi-leaded continuously cast products than for the leaded ingot cast products. This improvement is believed to be due to the more uniform distribution of the fine lead particles which characterize the semi-leaded continuously cast heats.

Many modifications and variations of the invention will be apparent to those skilled in the art in light of the foregoing detailed disclosure. Therefore it is to be understood that, within the scope of the appended claims, the invention can be practiced otherwise than as specifically shown and described.

We claim:

1. In an apparatus for continuously casting alloyed steel products, the improvement comprising:

(a) stopper rod means for controlling the flow of liquid steel from a tundish nozzle;

(b) said rod means having a guide passage through which a alloying wire can be fed, a cooling passage adjacent said guide passage, and a hole in one end forming an enlarged extension of said guide passage;

(c) heat meltable plug means for temporarily closing said hole; and (d) meltable closure means for temporarily closing said guide passage.

2. In an apparatus for continuously casting alloyed steel products including a tundish having a nozzle defining a pouring opening and a shroud extending from said pouring opening, the improvment comprising:

(a) stopper rod means in said tundish having a nose portion which cooperates with said nozzle to control the flow of liquid steel therethrough;

(b) said rod means including a guide passage through which a alloying wire can be fed, a cooling passage adjacent said guide passage, and a hole in said nose portion forming an enlarged extension of said guide passage;

(c) heat meltable plug means for temporarily closing said hole; and (d) heat meltable closure means for temporarily closing said guide passage.

3. An improvement as claimed in claim 2 including means for introducing a lead wire and an inert gas into said guide passage.

4. In an apparatus for continuously casting alloyed steel products including a tundish having a nozzle defining a pouring opening and a shroud extending from said opening, the improvement comprising:

(a) stopper rod means in said tundish having a nose portion which cooperates with said nozzle to control the flow of liquid steel therethrough;

(b) a wire guide tube in said rod means;

(c) a cooling tube around said guide tube;

(d) said rod means having a hole in said nose portion forming an enlarged extension of said guide tube;

(e) a heat meltable plug temporarily closing said hole;

(f) heat meltable means spaced from said plug for temporarily closing the end of said guide tube;

(g) means for introducing gas into said cooling tube; and (h) means for introducing an alloying wire and an inert gas into said guide tube.

5. In a process of leading continuously cast steel products wherein a supply of liquid steel in a tundish flows out through a nozzle and a cooperating shroud into a casting mold while a lead wire and an inert gas are fed through a gas cooled guide passage in a stopper rod to the area of the nozzle, the flow of liquid steel from the nozzle opening being controlled by raising and lowering the stopper rod in relation to the nozzle, the improvement comprising the steps of temporarily closing the guide passage and a cooperating hole in the nose of the stopper rod with heat meltable closure means, seating the nose of the stopper rod to close the nozzle while liquid steel is introduced into the tundish, initiating pouring by raising the stopper rod from the nozzle, and thereafter melting out said closure means to permit the lead and inert gas to escape from the stopper rod when a steady-state flow condition of liquid steel past the stopper rod nose has been attained.

6. The improvement as claimed in claim 5, wherein the guide passage and a cooperating hole in the nose of the stopper rod are separately closed.

* * * * *